US006244255B1

(12) United States Patent
Sagata et al.

(10) Patent No.: US 6,244,255 B1
(45) Date of Patent: Jun. 12, 2001

(54) MOUNTING STRUCTURE FOR EGR VALVE OR EGR TUBE

(75) Inventors: Munehiro Sagata, Nagoya; Yasuo Sunaga, Koga, both of (JP)

(73) Assignees: Aichi Kikai Kogyo Kabushiki Kaisha, Nagoya; Sanoh Kogyo Kabushiki Kaisha, Koga, both of (JP)

( * ) Notice: Subject to any disclaimer, the term of this patent is extended or adjusted under 35 U.S.C. 154(b) by 0 days.

(21) Appl. No.: 09/471,112

(22) Filed: Dec. 23, 1999

(30) Foreign Application Priority Data

Dec. 25, 1998 (JP) ..... 10-376885

(51) Int. Cl.[7] ..... F02M 25/07

(52) U.S. Cl. ..... 123/568.11; 123/568.17; 123/568.18

(58) Field of Search ..... 123/568.11, 568.12, 123/568.15, 568.17, 568.18, 568.19, 568.2, 568.21, 568.26, 568.27, 568.28, 568.29, 568.3, 568.31

(56) References Cited

U.S. PATENT DOCUMENTS 1,793,556 * 2/1931 Moore ..... 123/568.17
4,329,965 * 5/1982 Ueda et al. ..... 123/568.18
4,381,755 * 5/1983 Caracciolo ..... 123/568.11
4,909,036 * 3/1990 Kimura ..... 123/568.17
4,938,176 7/1990 Tanaka et al. ..... 123/568.17
5,909,725 * 6/1999 Balsdon et al. ..... 123/568.11
5,970,960 * 10/1999 Azuma ..... 123/568.12
5,988,148 * 11/1999 Astner et al. ..... 123/568.11

FOREIGN PATENT DOCUMENTS 2-227545 9/1990 (JP) .
10-089160 4/1998 (JP) .

* cited by examiner

*Primary Examiner*—Willis R. Wolfe
(74) *Attorney, Agent, or Firm*—Dennison, Scheiner, Schultz & Wakeman

(57) ABSTRACT

A mounting structure is provided for an EGR valve or an EGR tube. The EGR valve or the EGR tube is made of stainless steel or cast iron which is high in the physical strength at a high temperature. The EGR valve or the EGR tube is mounted to an intake manifold made of aluminum by means of bolts or stud bolts. The EGR valve or the EGR tube has female threads provided therein into which the bolts or stud bolts are screwed. The intake manifold has through holes provided therein through which the bolts or stud bolts extend.

1 Claim, 6 Drawing Sheets

MOUNTING STRUCTURE FOR EGR VALVE OR EGR TUBE

BACKGROUND OF THE INVENTION

1. Field of the Invention

The present invention relates to a mounting structure in which an EGR valve or an EGR tube is mounted to an intake manifold made of aluminum.

2. Description of the Related Art

A known EGR (exhaust gas re-circulating system) for decreasing NOx and improving the fuel consumption in an internal engine is shown in FIG. 4. In this system, an exhaust gas introduced from an exhaust manifold 1 to an EGR tub e 2 is flow controlled by an EGR valve 3 and is then returned back via an intake manifold 4 to a combustion chamber. The problem is that while the EGR valve 3 is mounted by tightening nuts 6 onto stud bolts 5 implanted to the intake manifold 4, increase in temperature by the exhaust gas at the female threads in the intake manifold 4 into which the stud bolts 5 are screwed may decline the physical strength. Particularly, when the intake manifold 4 is made of aluminum, its physical strength may be declined even to a half by a temperature of almost 250° C. hence failing to maintain the axial force of holding the stud bolts 5 and causing leakage of the exhaust gas. For compensation, as shown in an enlarged primary part view of FIG. 5, a cooling water passage 4*b* is provided adjacent to the female threads 4*a* in the intake manifold 4 and is connected to water hoses 7 at the outside for supplying a cooling water to cool down the female threads 4*a*. This will however increase the number of relevant components, the overall weight, and thus the manufacturing cost.

In addition, as shown in FIG. 6, a mounting portion 10*a* of an EGR tube 10 may be joined to the intake manifold 4 made of aluminum with the use of stud bolts 5 and nuts 6. This structure also requires cooling of the female threads for the stud bolts 5 in the intake manifold 4 with cooling water.

SUMMARY OF THE INVENTION

It is an object of the present invention, in view of the above problems, to provide a mounting structure for EGR valve or EGR tube, which structure does not require cooling water passages or water hoses, while rigid mounting can be made without declining the axial force for holding bolts.

According to the present invention, there is provided a mounting structure for an EGR valve or an EGR tube. The EGR valve or the EGR tube is made of stainless steel or cast iron which is high in the physical strength at a high temperature. The EGR valve or the EGR tube is mounted to an intake manifold made of aluminum by means of bolts or stud bolts. The EGR valve or the EGR tube has female threads provided therein into which the bolts or stud bolts are screwed. The intake manifold has through holes provided therein through which the bolts or stud bolts extend.

Accordingly, the bolts or stud bolts may be inserted into the through holes in the aluminum intake manifold and may be screwed into the female threads in the EGR valve or EGR tube. Therefore, the EGR valve or the EGR tube can be fixedly joined to the intake manifold. Because the EGR valve or EGR tube is made of stainless steel or cast iron which is high in the physical strength in a high temperature, the female threads of the EGR valve or the EGR tube maintain the axial force of the bolts or stud bolts not to be declined even when they are exposed to a higher temperature caused by heat of the exhaust gas. Therefore, no leakage of the exhaust gas may be caused. Also, the need of cooling passages or water hoses for cooling the female threads in a conventional manner can be eliminated and both the overall weight and the cost can thus be reduced. Moreover, the space required for the passage or the water hoses is not needed thus making the overall structure compact in size.

DETAILED DESCRIPTION OF THE PREFERRED EMBODIMENTS

Embodiments of the present invention will be described referring to the accompanying drawings.

Figure 1:
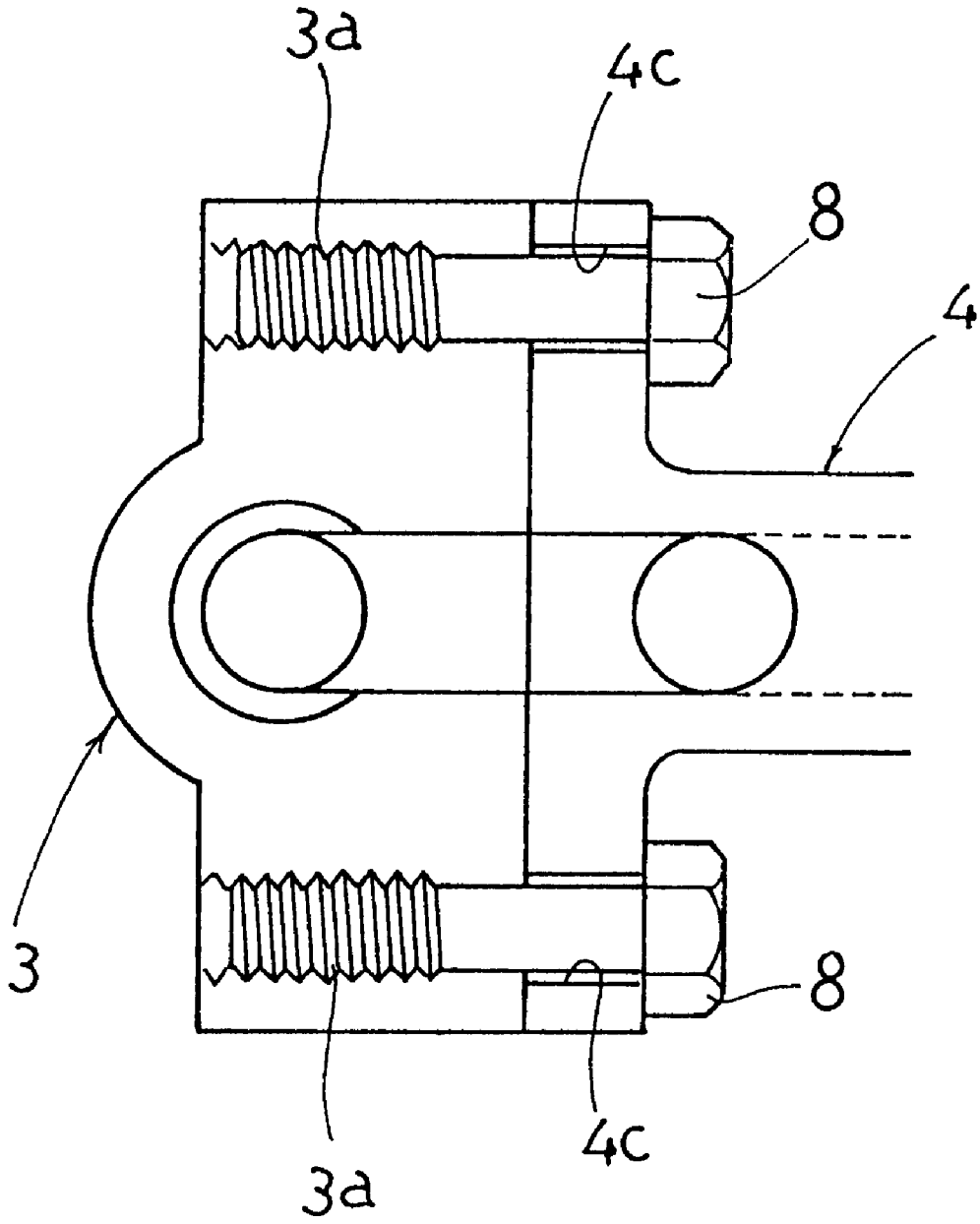
FIG. 1 is an enlarged primary part view showing an EGR valve mounted by bolts to an intake manifold according to a first embodiment of the present invention.
Figure 5:
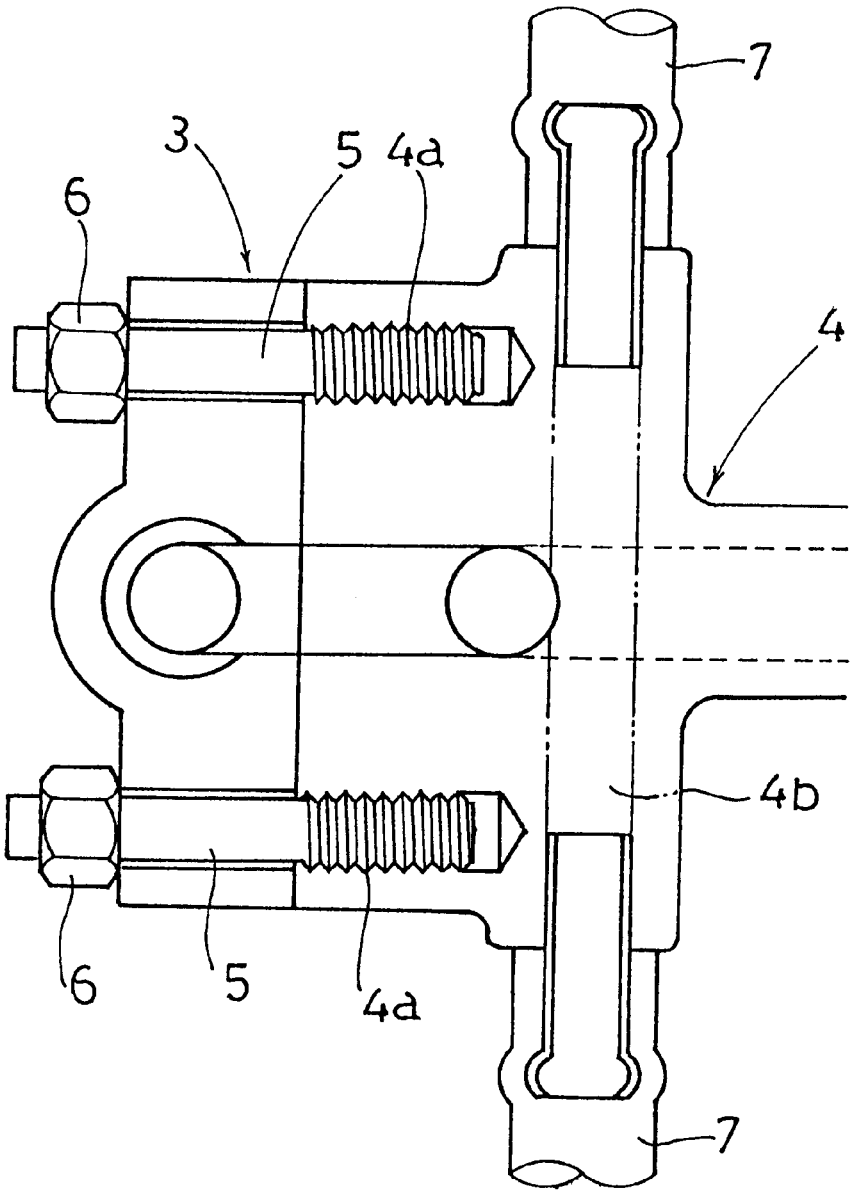
Fig 5 PRIOR ART
FIG. 5 is an enlarged view of a mounting area shown in FIG. 4.
Figure 6:
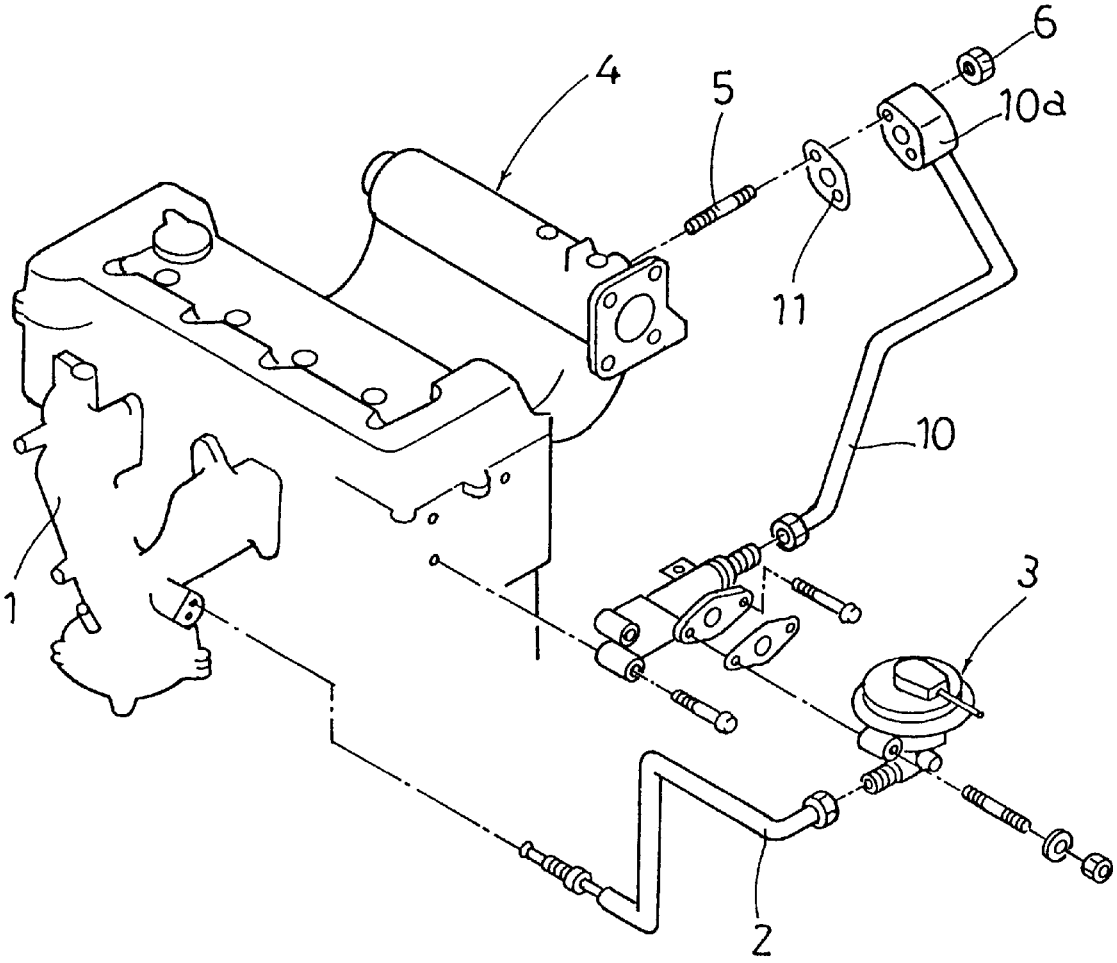
Fig 6 PRIOR ART
FIG. 6 is an exploded view showing a conventional mounting structure for mounting an EGR tube to an intake manifold.

FIG. 1 is an enlarged primary part view of a region where an EGR valve 3 is mounted to an equivalent of the intake manifold shown in FIG. 5. More particularly, the EGR valve 3 made of stainless steel or cast iron which is high in the physical strength at a high temperature is mounted to the intake manifold 4 made of aluminum with the use of bolts 8. Thus, the bolts 8 are inserted into through holes 4*c* formed in the aluminum intake manifold 4 at positions in alignment with female threads 3*a* provided in the stainless steel or cast iron EGR valve 3. The bolts 8 are then screwed into their corresponding female threads 3*a* in the EGR valve 3 for tightening the EGR valve 3 to the intake manifold 4. This allows the female threads 3*a* in the EGR valve 3 to remain high in the physical strength when it is heated up to a higher temperature by the heat of an exhaust gas, so that the bolts 8 can securely be held in the female threads 8 without being loosened or without causing leakage of the exhaust gas. Because the EGR valve 3 is rigidly tightened to the intake manifold 4 with the axial force of the bolts 8 being maintained even at the higher temperature, it is unnecessary to form a cooling water passage in the intake manifold 4 as in the conventional structure. Also, the use of water hoses for supplying cooling water is not needed, thus contributing to decrease the overall weight and to minimize the production cost. Moreover, the space required for connection with the water hoses is not needed, hence making the structure compact in size.

Figure 2:
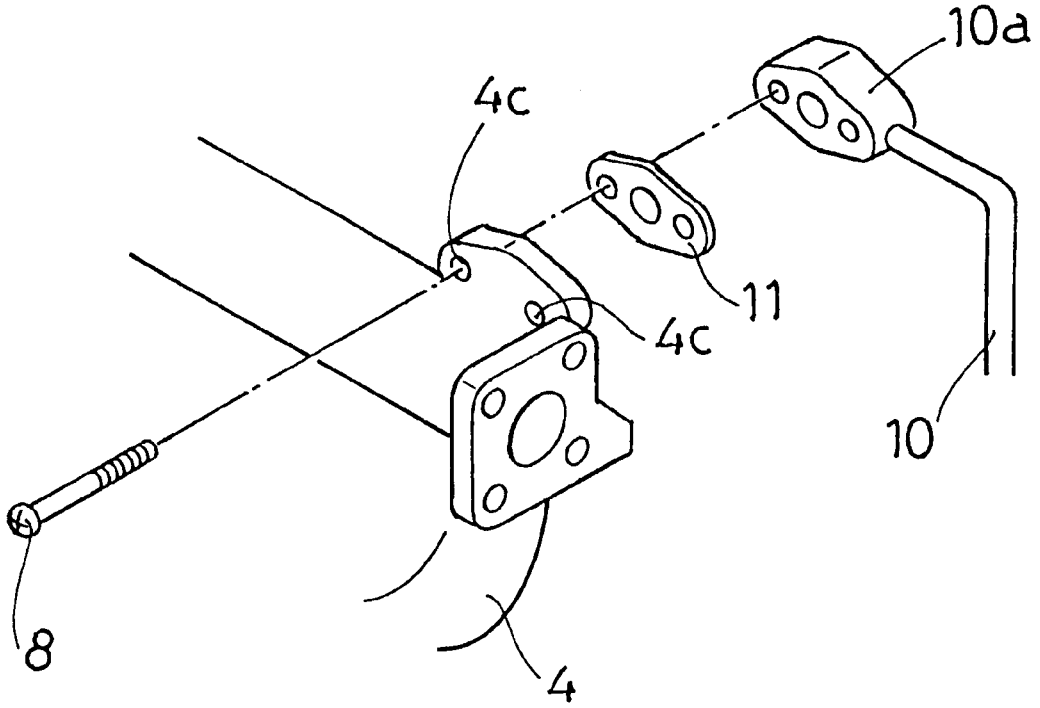
FIG. 2 is an exploded view showing an EGR tube mounted to an intake manifold according to a second embodiment of the present invention.

FIG. 2 is an exploded view showing the installation of an EGR tube to an intake manifold made of aluminum. As shown in FIG. 2, a mounting portion 10*a* of the EGR tube 10 is made of stainless steel or cast iron which is high in the physical strength at a high temperature. The mounting portion 1*a* has female threads provided therein for engaging threaded bolts 8. On the other hand, the aluminum intake manifold 4 has through holes 4*c* provided therein for receiving the bolts 8. By screwing the bolts 8 into the female threads in the mounting portion 10*a* of the EGR tube 10, the EGR tube 10 can be fixedly joined to the intake manifold 4, hence eliminating the use of water hoses or the like for cooling.

Figure 3:
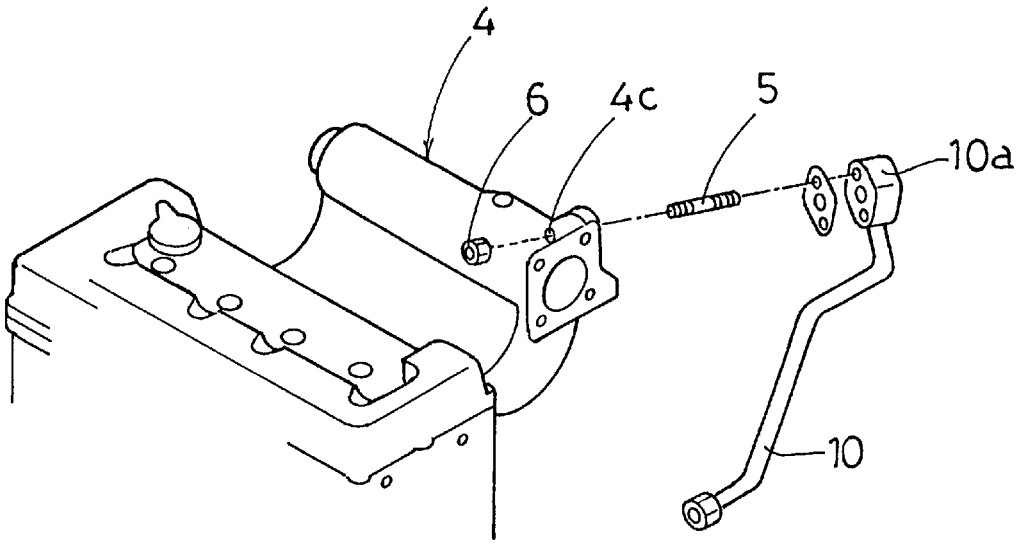
FIG. 3 is an exploded view showing the EGR tube mounted by stud bolts to the intake manifold.
Figure 4:
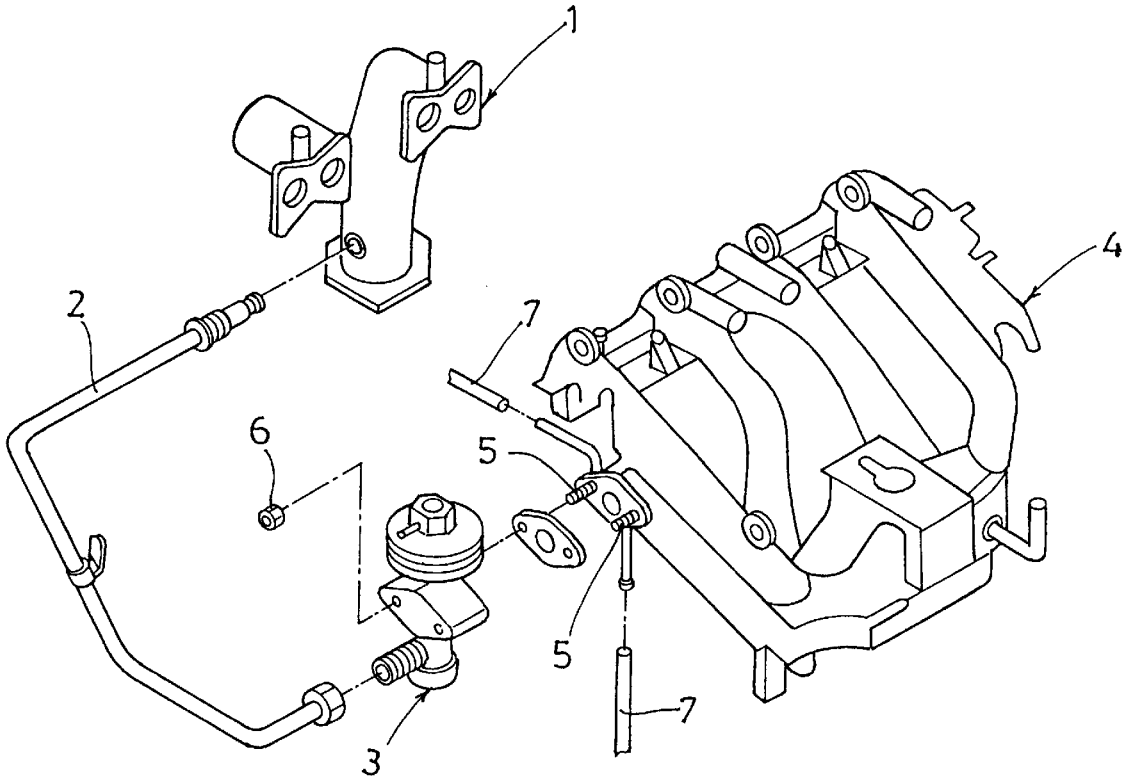
Fig 4 PRIOR ART
FIG. 4 is an exploded view showing a conventional mounting structure for mounting an EGR valve to an intake manifold.

FIG. 3 illustrates a modification where the bolts 8 shown in FIG. 2 are replaced by stud bolts 5 and nuts 6. In this case, the mounting portion 10*a* of the EGR tube 10 has female threads provided therein, while the intake manifold 4 has through holes 4*c* provided therein through which the stud bolts 5 can extend. Thus, the stud bolts 5 are inserted into the through holes 4*c*, screwed at one end into the female threads in the mounting portion 10*a* of the EGR tube 10, and tightened at the other end with their corresponding nuts 6. As a result, the EGR tube 10 can be fixedly joined to the intake manifold 4.

What is claimed is:

1. A mounting structure for mounting an EGR valve or an EGR tube to an intake manifold made of aluminum by means of bolts or stud bolts, the EGR valve or the EGR tube being made of stainless steel or cast iron that is high in the physical strength at a high temperature, wherein the EGR valve or the EGR tube has female threads provided therein into which the bolts or stud bolts are screwed, and the intake manifold has through holes provided therein through which the bolts or stud bolts extend.

* * * * *